US008479508B2

(12) United States Patent
Roychoudhury et al.

(10) Patent No.: US 8,479,508 B2
(45) Date of Patent: Jul. 9, 2013

(54) CATALYTIC BURNER APPARATUS FOR STIRLING ENGINE

(75) Inventors: Subir Roychoudhury, Madison, CT (US); Benjamin D. Baird, Rocky Hill, CT (US); Richard T. Mastanduno, Milford, CT (US); Bruce Crowder, North Haven, CT (US); Paul Fazzino, Rocky Hill, CT (US)

(73) Assignee: Precision Combustion, Inc., North Haven, CT (US)

( * ) Notice: Subject to any disclaimer, the term of this patent is extended or adjusted under 35 U.S.C. 154(b) by 856 days.

(21) Appl. No.: 12/655,702

(22) Filed: Jan. 6, 2010

(65) Prior Publication Data

US 2011/0146264 A1 Jun. 23, 2011

Related U.S. Application Data

(63) Continuation-in-part of application No. 11/803,464, filed on May 14, 2007, now Pat. No. 7,913,484, which is a continuation-in-part of application No. 11/364,402, filed on Feb. 28, 2006, now abandoned.

(60) Provisional application No. 60/799,857, filed on May 13, 2006.

(51) Int. Cl.
*F01B 29/10* (2006.01)

(52) U.S. Cl.
USPC ..... 60/524; 60/517

(58) Field of Classification Search
USPC ..... 60/517, 520, 524, 526
See application file for complete search history.

(56) References Cited

U.S. PATENT DOCUMENTS

| | | | | |
|---|---|---|---|---|
| 3,848,412 | A * | 11/1974 | Michels et al. | 60/517 |
| 4,255,121 | A | 3/1981 | Sugimoto | |
| 4,285,665 | A | 8/1981 | Enga | |
| 4,367,629 | A * | 1/1983 | Cann | 60/669 |
| 4,702,903 | A | 10/1987 | Keefer | |
| 4,965,052 | A | 10/1990 | Lowther | |
| 5,051,241 | A | 9/1991 | Pfefferle | |
| 5,590,526 | A | 1/1997 | Cho | |

(Continued)

FOREIGN PATENT DOCUMENTS

| | | | |
|---|---|---|---|
| EP | 1925883 | A1 | 5/2008 |
| WO | WO 84/00998 | A1 | 3/1984 |

(Continued)

OTHER PUBLICATIONS

Co-pending U.S. Appl. No. 12/587,593, filed on Oct. 8, 2009, in the names of Subir Roychoudhury, et al.; unpublished.

(Continued)

*Primary Examiner* — Hoang Nguyen

(57) ABSTRACT

The invention provides an apparatus for generating heat and transferring the heat to a heater head of an external combustion engine, preferably, a Stirling engine. Fuel and air are introduced into a combustion chamber and mixed to form an air/fuel mixture. The air/fuel mixture is combusted over a combustion catalyst positioned in physical contact with a heat spreader, which itself is positioned in physical contact with a heat acceptor surface. The heat acceptor surface is secured in thermal communication with the heater head. Depending upon the design of the heater head, heat flux from the heat acceptor surface into the heater head may occur radially or non-radially.

24 Claims, 6 Drawing Sheets

U.S. PATENT DOCUMENTS

| | | | | |
|---|---|---|---|---|
| 5,725,151 | A | 3/1998 | Hetrick | |
| 5,918,463 | A | 7/1999 | Penswick | |
| 6,183,241 | B1 | 2/2001 | Bohn | |
| 6,282,895 | B1 | 9/2001 | Johansson | |
| 6,381,958 | B1 * | 5/2002 | Kamen et al. | 60/517 |
| 6,491,236 | B1 | 12/2002 | Keller | |
| 6,513,326 | B1 | 2/2003 | Maceda | |
| 6,740,439 | B2 * | 5/2004 | Ban et al. | 429/479 |
| 6,746,657 | B2 | 6/2004 | Castaldi | |
| 6,755,021 | B2 | 6/2004 | Johansson | |
| 6,767,518 | B2 | 7/2004 | Ichikawa | |
| 6,775,982 | B1 | 8/2004 | Kitamura | |
| 6,857,260 | B2 | 2/2005 | Langenfeld | |
| 6,877,315 | B2 | 4/2005 | Clark | |
| 6,910,331 | B2 * | 6/2005 | Asai et al. | 60/517 |
| 6,931,848 | B2 | 8/2005 | Maceda | |
| 2004/0209205 | A1 | 10/2004 | Gomez | |
| 2005/0028445 | A1 | 2/2005 | Roychoudhury | |
| 2007/0151154 | A1 | 7/2007 | Lyubovsky | |
| 2008/0078175 | A1 | 4/2008 | Roychoudhury | |
| 2008/0127553 | A1 | 6/2008 | Roychoudhury | |
| 2009/0113889 | A1 | 5/2009 | Roychoudhury | |

FOREIGN PATENT DOCUMENTS

| | | | |
|---|---|---|---|
| WO | WO 2004060546 | A2 | 7/2004 |
| WO | WO 2008048353 | A2 | 4/2008 |
| WO | WO 2008/082361 | | 7/2008 |

OTHER PUBLICATIONS

Co-pending U.S. Appl. No. 12/655,703, filed on Jan. 6, 2010, in the names of Subir Roychoudhury, et al.; unpublished.

* cited by examiner

CATALYTIC BURNER APPARATUS FOR STIRLING ENGINE

CROSS-REFERENCE

This application is a continuation-in-part of U.S. patent application Ser. No. 11/803,464, filed May 14, 2007, which claims the benefit of U.S. Provisional Application No. 60/799,857, filed May 13, 2006. This application is a continuation of U.S. patent application Ser. No. 11/803,464, filed May 14, 2007, which is also a continuation-in-part of U.S. patent application Ser. No. 11/364,402, filed Feb. 28, 2006. The aforementioned priority applications are incorporated herein in their entirety by reference.

GOVERNMENT RIGHTS

This invention was made with government support under U.S. Contract No. N00014-08-C-0286. The U.S. government holds certain rights in this invention.

FIELD OF THE INVENTION

The present invention is directed to an apparatus for providing heat to an external combustion engine, particularly, towards providing heat to an internal heat acceptor, commonly referred to as a "heater head," of an external combustion engine, more particularly, a Stirling Engine. In conventional Stirling engines, the heater head consists of a cylinder having a circumferential band of heat conductive material for radial heat flux into the engine. This invention pertains to a more general method of generating heat and transferring the heat to the heater head of a Stirling Engine via radial heat flux or non-radial heat flux depending upon design features of the heater head.

BACKGROUND OF THE INVENTION

As is well known in the art, Stirling Engines convert a temperature difference directly into movement. Such movement, in turn, may be utilized as mechanical energy or converted into electrical energy. The Stirling Engine cycle comprises repeated heating and cooling of a sealed amount of working gas in a chamber. When the gas in the sealed chamber is heated, the pressure increases and acts on a piston thereby generating a power stroke. When the gas in the sealed chamber is cooled, the pressure decreases, thereby producing a return stroke of the piston.

Stirling Engines require an external heat source to operate. The heat source may be the result of combustion and may also be solar or nuclear. In practicality, increasing the rate of heat transfer to the working fluid within the Stirling Engine is one primary mechanism for improving the performance of the Stirling Engine. One skilled in the art, however, will recognize that performance may be improved through a more efficient cooling process as well.

U.S. Pat. No. 5,590,526 to Cho describes a conventional prior art burner for a Stirling Engine. Generally, a combustion chamber provides an air-fuel mixture for the burner by mixing air and fuel supplied from air inlet passageways and a fuel injection nozzle, respectively. An igniter produces a flame by igniting the air-fuel mixture formed within the combustion chamber. A heater tube absorbs the heat generated by the combustion of the air-fuel mixture and transfers the heat to the Stirling Engine working fluid. Exhaust gas passageways discharge an exhaust gas.

A more efficient heat source is described in U.S. Pat. No. 5,918,463 to Penswick, et al. (hereinafter referred to as "Penswick") in order to overcome the problem of delivering heat at non-uniform temperatures. As described by Penswick, Stirling engines require the delivery of concentrated thermal energy at uniform temperature to the engine working fluid. (See Penswick Column 1, lines 39-40). In the approach disclosed by Penswick, a burner assembly transfers heat to a Stirling Engine heater head of cylindrical shape, primarily, by radiation and secondarily by convection. (See Penswick Column 1, lines 58-61). Penswick discloses the device with respect to an external combustion engine, a Stirling Engine, and a Stirling Engine power generator. (See Penswick Column 2, lines 36-66.)

With respect to the external combustion engine, the Penswick burner assembly includes a housing having a cavity sized to receive a heater head and a matrix burner element carried by the housing and configured to transfer heat to the heater head. (See Penswick Column 2, lines 38-41). With respect to the Stirling Engine, the Penswick burner assembly includes a housing having a cavity sized to receive a heater head and a matrix burner element configured to encircle the heater head in spaced apart relation. (See Penswick Column 2, lines 48-51). Lastly, with respect to the Stirling Engine power generator, the Penswick burner assembly includes a housing having a cavity sized to receive the heater head and a matrix burner element configured to encircle the heater head in spaced apart relation. (See Penswick Column 2, lines 63-66).

The Penswick burner housing supports a fiber matrix burner element in radially spaced apart, but close proximity to, a radially outer surface of the Stirling Engine heater head. (See Penswick Column 4, lines 19-21). Penswick further discloses that combustion may occur in radiant or blue flame. In the radiant mode, combustion occurs inside matrix burner element which, in turn, releases a major portion of the energy as thermal radiation. In the blue flame mode, blue flames hover above the surface and release the major part of the energy in a convective manner. (See Penswick Column 4, lines 42-54). Hence, operation of the Penswick burner requires space between the combusting matrix element and the heater head in order to operate in any of the modes disclosed by Penswick.

Moreover, Penswick describes a heat chamber that is formed within the burner housing between the inner surface of the matrix burner element and the outer surface of the Stirling Engine heater head. Heat transfer occurs within the heat chamber primarily through radiation from the matrix burner element to the Stirling Engine heater head, and secondarily via the passing of hot exhaust gases over the Stirling Engine heater head. (See Penswick Column 6, lines 1-7, and FIG. 5). According to Penswick, heat being delivered through the heat chamber and over the Stirling Engine heater head is conserved as a result of insulation. (See Penswick Column 7, lines 17-20).

In U.S. Pat. No. 6,183,241 to Bohn, et al. (hereinafter referred to as "Bohn"), computer simulation was employed to develop an inward-burning, radial matrix gas burner to attempt to solve the difficulty of obtaining uniform flow and uniform distribution in a burner matrix. (See Bohn, Abstract and Column 1, lines 54-56). According to Bohn, metal matrix burners have received much attention because of their ability to burn fossil fuels with very low emissions of nitrogen oxides. (See Bohn, Column 1, lines 37-39). With respect to the transfer of heat to the Stirling Engine heater head, Bohn also teaches that a significant fraction of the heat of combustion is released as infrared radiation from the matrix. (See Bohn, Column 1, lines 42-44).

Bohn's solution provides a high-temperature uniform heat via a cylindrical-shaped radial burner, a curved plenum, porous mesh, divider vanes, and multiple inlet ports. Extended upstream fuel/air mixing point provide for uniform distribution of a preheated fuel/air mixture. (See Bohn, Column 4, lines 56-61). Bohn teaches the use of a space formed between a heat pipe and the burner matrix and the use of a mesh screen therebetween to promote uniform radiant heat transfer. Unfortunately, the solution offered by Bohn still is too complex and inefficient for desired uses.

Yet another method for transferring heat to the heater head of a Stirling Engine is disclosed in U.S. Pat. No. 6,877,315 to Clark, et al. (hereinafter referred to as "Clark"). According to Clark, the Stirling Engine heater head is generally arranged vertically with a burner surrounding it to supply heat so that hot exhaust gases from the burner can escape upwards. The device disclosed by Clark enhances the transfer of heat to the Stirling Engine heater head to increase its efficiency by employing fins to increase the heater head surface area. (See Clark, Column 1, lines 19-33). Clark teaches that a problem still exists in the art with respect to the effective and efficient transfer of heat to a Stirling Engine heater head as late as 2003.

In the device disclosed by Clark, an annular burner surrounds the heat transfer head and provides the heat source. The heat transfer head is provided with a plurality of fins to promote and enhance heat transfer. (See Clark, FIG. 1 and Column 2, lines 34-45). Radiant heat is transferred to the heater head and also to other substantially parallel fins to further enhance the heat transfer. (See Clark, Column 1, lines 63-65). As with the other prior art cited, the relative spaced-apart relationship that allows heat to be transferred radiantly is important. Clark teaches that the source of radiant heat is arranged opposite to the plurality of fins such that radiant heat is directed into the spaces between adjacent fins. (See Clark, Column 3, lines 4-6).

Another problem with burner devices for a Stirling Engine is described in U.S. Pat. No. 6,513,326 to Maceda, et al. (hereinafter referred to as "Maceda"). Maceda discloses a conventional burner device in which air and fuel are injected into the burner and then ignited to cause heat to be generated. The working gas is carried within a plurality of heater tubes that are positioned proximate to the burner device so that heat is transferred from the burner device to the working gas flowing within the heater tubes. (See Maceda, Column 1, lines 39-46). As known to one skilled in the art, the heater tubes are positioned proximate to the burner device such that heat can be radiantly transferred from the burner device to the tubes.

According to Maceda, heat is not uniformly distributed to the working gas within the heater tubes because a single burner device is used to generate and effectuate the heat transfer. (See Maceda, Column 1, lines 55-59). As a solution to the problem of uniform heat distribution, Maceda teaches the use of a heat exchange manifold employing multiple platelets that are stacked and joined together. (See Maceda, Column 2, lines 22-24). Instead of having one large burner device with one combustion chamber and a multiple of heater tubes per piston cylinder, the Maceda manifold provides a substantially greater number of individual combustion chambers. (See Maceda, Column 2, lines 51-57). Unfortunately, the solution offered by Maceda still is too complex and inefficient for desired uses.

Yet another apparatus and heat transfer method similar to the aforementioned disclosures of Cho and Maceda, are taught in U.S. Pat. No. 6,857,260 B2 (hereinafter "Langenfeld"). Langenfeld's apparatus comprises a cylindrical heater head having attached thereto a plurality of heater tubes containing a working fluid. Langenfeld teaches that exhaust gases from flame combustion are diverted past the heater tubes such that heat is transferred from the gases to the heater tubes, then from the heater tubes to the working fluid of the engine. The Langenfeld apparatus and method rely on transfer of heat via gas convection and flame radiation, as found in the previously described art.

Catalytic reactors are also known as disclosed, for example, in U.S. Pat. No. 4,965,052 (hereinafter "Lowther"), which teaches an integrated engine-reactor consisting of a first cylinder having a reciprocating piston, a second chamber filled with a catalytic material and in fluid communication with the first cylinder, and a third chamber in fluid communication with the second chamber. A chemical reaction is conducted in the first chamber and catalytically driven further in the second chamber; while the third chamber is adapted to receive combustion products from the first and second chambers. The disclosed catalyst is in the form of particulate solids, such copper-zinc oxide or zeolites. Since the disclosed apparatus employs a working fluid in direct communication with all three chambers, the disclosure does not specifically relate to an apparatus for transferring heat to the acceptor head of an external combustion engine.

Based on the foregoing, what is needed is a simple, efficient and effective apparatus and method for generating heat and transferring the heat to a Stirling engine via radial or non-radial heat flux depending upon the design of the heater head.

A related patent application pertaining to generating and transferring heat to the heater head of a Stirling Engine is currently being prosecuted under Applicants' U.S. patent application Ser. No. 11/803,464, filed May 14, 2007.

SUMMARY OF THE INVENTION

In a first aspect, the present invention provides a simple, efficient, and effective catalytic reactor for generating heat and transferring the heat to the heater head of a Stirling engine. The apparatus comprises the following components:

(a) a housing comprising a combustion chamber;
(b) a fuel inlet means for feeding a fuel into the chamber;
(c) an oxidant first inlet means for feeding an oxidant into the chamber;
(d) optionally, an oxidant second inlet means for feeding additional oxidant into the chamber;
(e) a combustion catalyst positioned within the chamber in fluid communication with the fuel and oxidant inlet means;
(f) a heat acceptor surface positioned within the chamber downstream from the catalyst, the heat acceptor surface positioned in thermal communication with a heater head of a Stirling engine;
(g) a heat spreader positioned in between the catalyst and the heat acceptor surface and contacting both the catalyst and the heat acceptor surface;
(h) an ignition means positioned within the chamber for igniting the catalyst and thus initiating flameless combustion of the fuel with the oxidant; and
(i) one or more outlet means for exhausting combustion gases from the chamber.

In a second aspect, this invention provides for an improved Stirling engine having a piston undergoing reciprocating linear motion within an expansion cylinder containing a working fluid heated through a heater head. The improvement comprises employing a catalytic reactor for generating heat and transferring the heat to the heater head, the reactor comprising:

a) a housing comprising a combustion chamber;

(b) a fuel inlet means for feeding a fuel into the chamber;

(c) an oxidant first inlet means for feeding an oxidant into the chamber;

(d) optionally, an oxidant second inlet means for feeding additional oxidant into the chamber;

(e) a combustion catalyst positioned within the chamber in fluid communication with the fuel and oxidant inlet means;

(f) a heat acceptor surface positioned within the chamber downstream from the catalyst, the heat acceptor surface positioned in thermal communication with a heater head of a Stirling engine;

(g) a heat spreader positioned in between the catalyst and the heat acceptor surface and contacting both the catalyst and the heat acceptor surface;

(h) an ignition means positioned within the chamber for igniting the catalyst and thus initiating flameless combustion of the fuel with the oxidant; and (i) one or more outlet means for exhausting combustion gases from the chamber.

In a third aspect, this invention provides for a method of generating heat and transferring the heat to a heater head of a Stirling engine. The method comprises:

(1) employing a catalytic reactor for generating heat and transferring the heat to the heater head, the reactor comprising (a) a housing comprising a combustion chamber; (b) a fuel inlet means for feeding a fuel into the chamber; (c) an oxidant first inlet means for feeding an oxidant into the chamber; (d) optionally, an oxidant second inlet means for feeding additional oxidant into the chamber; (e) a combustion catalyst positioned within the chamber in fluid communication with the fuel and oxidant inlet means; (f) a heat acceptor surface positioned within the chamber downstream from the catalyst, the heat acceptor surface positioned in thermal communication with a heater head of a Stirling engine; (g) a heat spreader positioned in between the catalyst and the heat acceptor surface and contacting both the catalyst and the heat acceptor surface; (h) an ignition means positioned within the chamber for igniting the catalyst and thus initiating flameless combustion of the fuel with the oxidant; and (i) one or more outlet means for exhausting combustion gases from the chamber;

(2) feeding a fuel through the fuel inlet means into the combustion chamber;

(3) feeding an oxidant through the oxidant first inlet means into the combustion chamber;

(4) optionally, feeding additional oxidant through the oxidant second inlet means into the chamber;

(5) in the chamber, contacting the fuel and the oxidant with the combustion catalyst;

(6) igniting the catalyst with the ignition means so as to initiate flameless combustion of the fuel with the oxidant thereby generating heat of combustion, the heat being transferred from the combustion catalyst to the heat acceptor surface and therefrom to the heater head into the Stirling engine; and (7) exhausting combustion gases through the one or more outlet means.

In an alternative embodiment of the inventions described hereinabove, the heat acceptor surface (f) and the heat spreader (g) may be constructed as one composite unit.

DETAILED DESCRIPTION OF THE INVENTION

Figure 1:
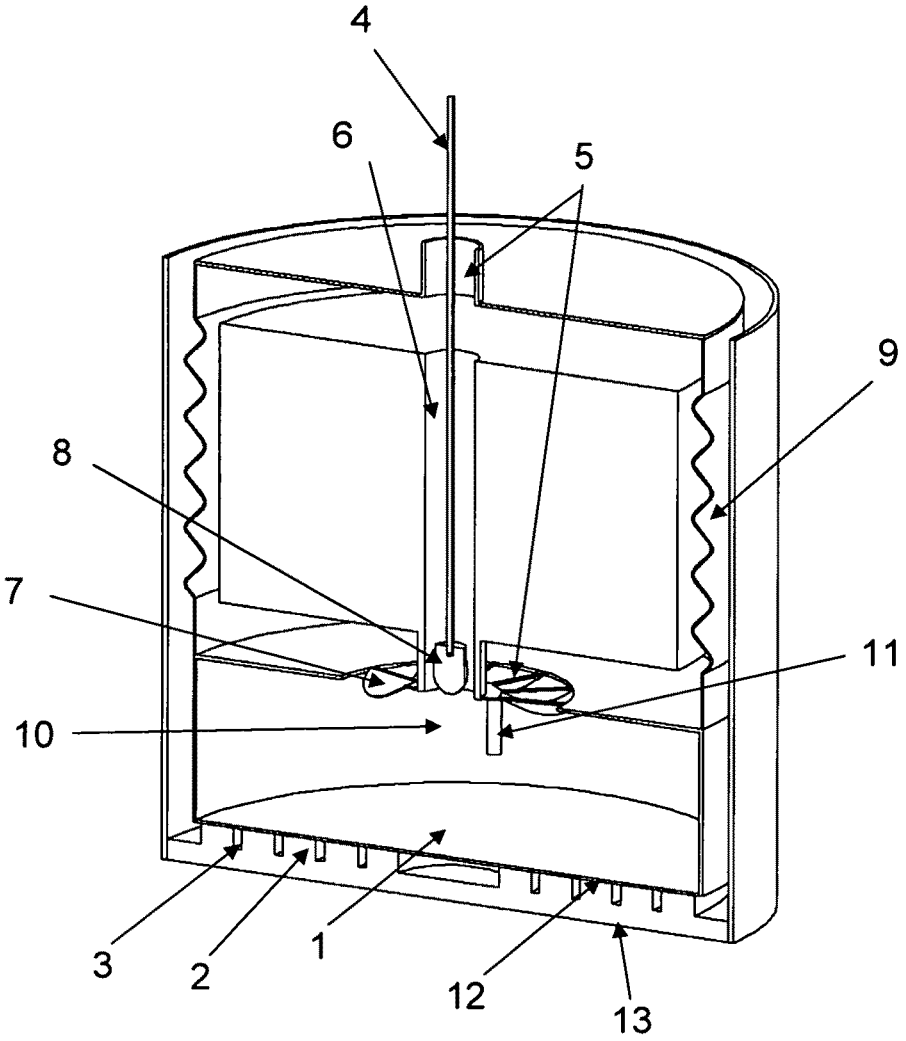
FIG. 1 provides an isometric cross-sectional view of an embodiment of a catalytic reactor in accordance with the present invention.

In one preferred embodiment of the invention, with reference to FIG. 1 (and exploded view in FIG. 2), fuel is introduced into a combustion chamber via fuel inlet 4; and oxidant is introduced into the combustion chamber via oxidant first inlet path 5. Optionally, additional oxidant may be introduced into the combustion chamber via oxidant second inlet path 6. The fuel and oxidant are mixed in combustion chamber 10. The mixing of fuel and oxidant are advantageously enhanced by incorporating a fuel nozzle atomizer 8 and swirler 7, described hereinafter. The mixture of fuel and oxidant contacts combustion catalyst 1 positioned within the chamber. The catalyst is lit-off using ignition means 11, and flameless catalytic combustion occurs with formation of combustion products and heat of reaction. Advantageously, combustion catalyst 1 comprises an ultra-short-channel-length metal substrate; preferably, an ultra-short-channel-length metal substrate in a mesh or foam form. More preferably, combustion catalyst 1 comprises a Microlith® brand ultra-short-channel-length metal mesh substrate, and most preferably, comprises said Microlith® brand ultra-short-channel-length metal mesh substrate having deposited thereon one or more noble metals. Combustion catalyst 1 is positioned in direct physical contact (i.e., non-spaced apart relation) with a composite heat spreader-heat acceptor surface 2. In preferred composite embodiment 2, one side thereof functions as the heat spreader 12 via direct physical and thermal contact with the combustion catalyst 1. Moreover, heat spreader side 12 is advantageously machined or cast with a plurality of grooves or channels 3 that provide pathways for gas flow and heat transfer via convection. The opposite side 13 of composite 2 comprises a heat acceptor surface, in this case a flat surface, which functions to transmit heat to the heater head of the Stirling engine. The combustion gases exit through channels or grooves 3 in composite 2 advantageously via recuperator 9, such that waste heat of combustion is transferred from the combustion gases to preheat the oxidant in oxidant first inlet means 5.

Figure 2:
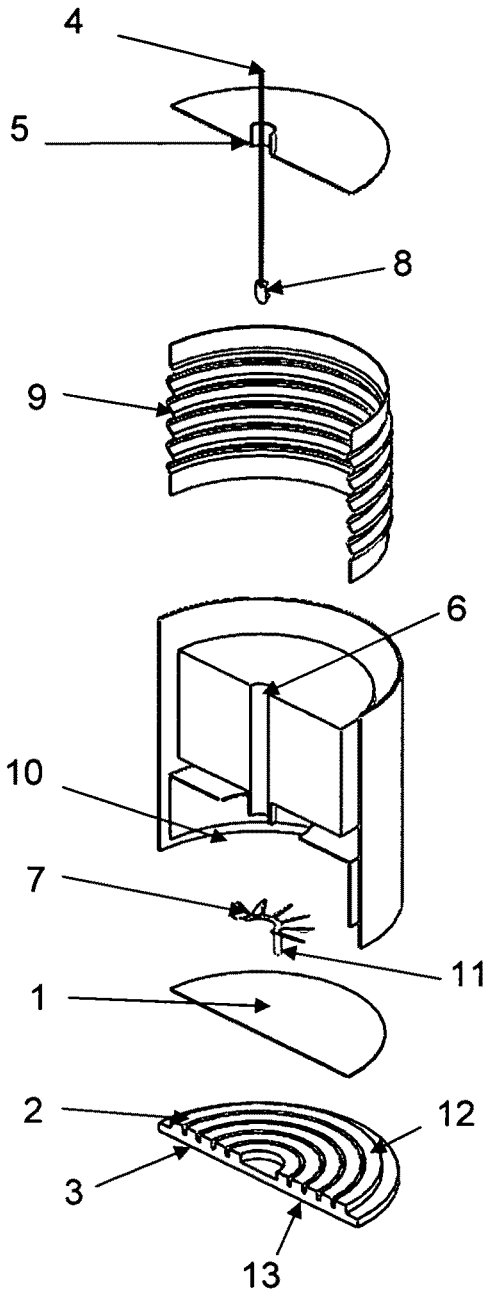
FIG. 2 depicts an exploded view of an embodiment of the catalytic reactor of FIG. 1.

FIG. 2 depicts an exploded view of the aforementioned components 1-13 of the preferred apparatus depicted in FIG. 1.

Oxidant first inlet means 5 is the primary inlet for feeding the oxidant, whereas oxidant second inlet means 6 is an optional feature. The purpose of oxidant second inlet means 6 is to facilitate atomizing the fuel fed through fuel inlet means 4 and to facilitate cooling when a pressurized fuel nozzle injector-atomizer 8 is employed. Consequently, oxidant second inlet means 6 is a preferred feature when a liquid or heavier fuel is employed, such as JP-8 fuel. The oxidant is advantageously split between inlet means 5 and inlet means 6 in a range from about 80:20 to 100:0, respectively. An oxidant split of about 90±3 percent to inlet 5 and about 10±3 percent to inlet 6 is preferred. It is noted that the oxidant entering through oxidant first inlet means 5 is advantageously a recuperated feed, meaning that the oxidant has been passed through a heat exchange zone to recuperate heat from the exhaust gases so as to preheat the inlet oxidant in inlet 5 for higher burner efficiency. Oxidant second inlet 6 preferably remains unheated to facilitate cooling the tip of the fuel nozzle.

Figure 3:
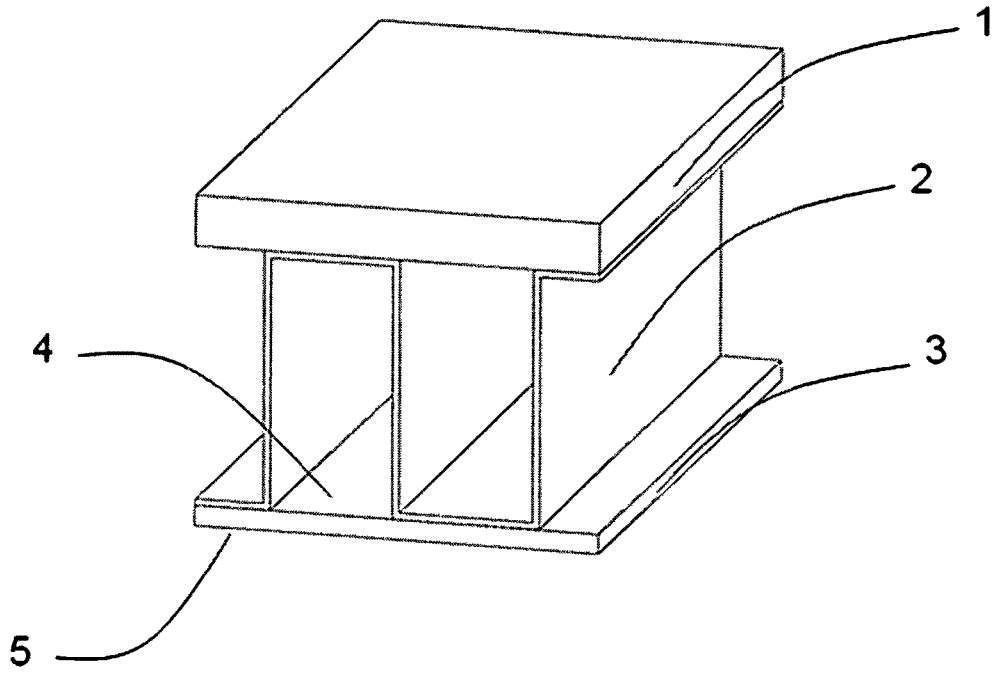
FIG. 3 depicts an embodiment of a catalytic reactor in accordance with the present invention.

In FIGS. 1 and 2 the heat spreader and heat acceptor surface are combined into one composite unit with dual functionality as described hereinbefore. In an alternative embodiment of the invention, the heat spreading functionality and the heat acceptor functionality are split between two components. In this embodiment, as shown in FIG. 3, a burner assembly is constructed comprising a combustion catalyst 1, a heat acceptor surface 3, and a heat spreader 2 positioned in between and in direct physical (i.e., non-spaced apart relation) and thermal contact with the combustion catalyst and the heat acceptor surface The heat acceptor surface 3 has an interior surface 4 in direct communication with the heat spreader 2 and an exterior surface 5 that functions to transmit heat conductively or convectively to the heater head of the external combustion engine. As shown, the heat spreader 2 is comprised of a plurality of ridges and valleys, and a plurality of channels or grooves through which the combustion gases flow, contact the heat acceptor surface, and then exit the reactor.

The walls of the combustion chamber can be constructed of any material capable of withstanding combustion conditions. Suitable materials include, without limitation, stainless steel and any suitable alloy, preferably, a steel alloy.

The present invention comprises a flameless, catalytic combustion zone. As those skilled in the art know, combustion comprising a flame must address high flame temperature conditions and provide flame-holding techniques. Flameless catalytic combustion avoids these problems associated with flame burners. As with all fuel-consuming systems, autoignition should be addressed.

The combustion catalyst advantageously employed in the process of this invention comprises an ultra-short-channel-length metal substrate, preferably, an ultra-short-channel-length metal substrate in mesh or foam form, and more preferably, an ultra-short-channel-length metal mesh substrate having deposited thereon one or more noble metals, preferably, platinum, palladium, and/or any other of the known noble metals, for efficient and effective flameless combustion of the fuel with the oxidant with generation of heat of combustion. This type of catalyst is preferably employed in a mesh or foam form; but the invention is not limited to such structures, and other structures may be suitable. In a most preferred embodiment, the catalyst comprises Microlith® brand ultra-short-channel-length metal mesh substrate having deposited thereon one or more noble metals, the catalyst being commercially available from Precision Combustion, Inc., located in North Haven, Conn. Microlith® brand ultra-short-channel-length metal mesh substrate technology is a novel catalyst design concept comprising a series of ultra-short-channel-length, low thermal mass, metal monoliths that replace conventional prior art monoliths having longer channel lengths. For the purposes of this invention, the term "ultra-short-channel-length" refers to channel lengths in a range from about 25 microns (μm) (0.001 inch) to about 500 microns μm (0.02 inch). In contrast, the term "long channels" pertaining to prior art monoliths refer to channel lengths greater than about 5 mm (0.20 inch).

The preferred Microlith® brand ultra-short-channel-length metal mesh substrate promotes the packing of more active area into a small volume and provides increased reactivity area for a given pressure drop, as compared with prior art monoliths. Whereas in a conventional honeycomb monolith having conventional long channels, a fully developed boundary layer is present over a considerable length of the device; in contrast, the ultra-short-channel-length characteristic of the Microlith® brand substrate avoids boundary layer buildup. Since heat and mass transfer coefficients depend on the boundary layer thickness, avoiding boundary layer buildup enhances transport properties. The advantages of employing the ultra-short-channel-length metal substrate, and preferably, the Microlith® brand ultra-short-channel-length metal mesh substrate, to control and limit the development of a boundary layer of a fluid passing therethrough is described in U.S. patent application Ser. No. 10/832,055 which is a Continuation-In-Part of U.S. Pat. No. 6,746,657 to Castaldi, both incorporated in their entirety herein by reference.

The combustion catalyst can be pressure contacted to the heat spreader. Alternatively, the catalyst can be secured to the heat spreader with any conventional and suitable attachment means (not shown in figures). In one embodiment, the catalyst is pressure contacted to the heat spreader by means of spring coils positioned on the catalyst face opposite the face contacting the heat spreader.

Energy, in the form of heat, is rapidly extracted from the combustion chamber predominantly by conduction from the catalyst to the heat spreader to the heat acceptor surface and therefrom predominantly by conduction or convection to the heater head. Heat is also transferred via convection of combustion gases through channels in the heat spreader as well as via radiation of the hot catalytic substrate.

The heat spreader to which the catalyst is physically contacted is constructed of any thermally conductive metal capable of withstanding combustion conditions. Suitable materials include, without limitation, stainless steel, steel and nickel alloys, and iron and chrome alloys, as well as other high temperature materials as known in the art. As mentioned hereinbefore, the heat spreader can be provided in one composite unit with the heat acceptor surface, as shown with a plurality of channels and grooves in FIGS. 1 and 2, or provided as a separate component distinct from the heat acceptor surface, as shown in a corrugated structure in FIG. 3. With reference to FIG. 3, the heat spreader is constructed in the form of metallic sheets having a thickness from about 25 μm (0.001 inch) to about 500 μm (0.020 inch). In a preferred embodiment with reference to FIG. 4, the heat spreader comprises one or more metallic sheets bent and folded, preferably, into a corrugated set of fins. For the purpose of this invention, the term "corrugated" refers to a structure having alternating ridges and furrows (valleys). Each fin is advantageously designed from about 6 millimeters (mm) (¼ inch) to about 50 mm (2 inches) in height and from about 12 mm (½ inch) to about 75 mm (3 inches) in length. Advantageously, the pitch, i.e., the number of fins per inch, ranges from about 5 fins per inch (2 fins per cm) to about 50 fins per inch (20 fins per cm). The corrugated fins are constructed, more preferably, with about 90° angles at the top of the ridges and bottom of the furrows for maximum contact with both the catalyst 1 and heat acceptor surface 3. If desired, the fins may be arranged in concentric circles extending to a radius the size of any desired heat acceptor surface.

Figure 4:
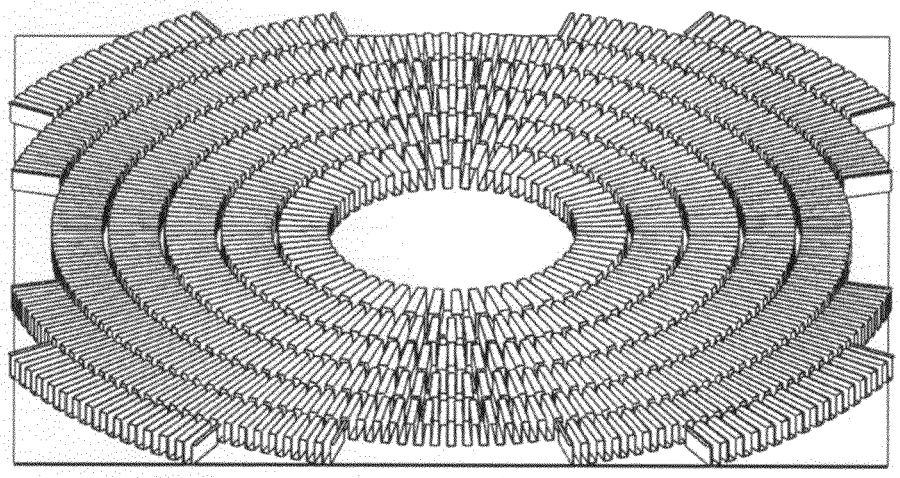
FIG. 4 depicts an embodiment of a heat spreader in accordance with this invention.

As shown in FIG. 4, in a preferred embodiment, each fin can be bent along its length into a slight wave shape so as to maintain squareness of the bends and to ensure flat surfaces for contact with the catalyst and the heat acceptor surface. Even more preferably, the concentric circles of fins can be arranged with the waves pointing in substantially the same direction, such that the wave faces one direction in one circle and faces substantially the same direction in any adjacent circle.

Since conduction is the preferred method of transferring heat of combustion in this invention, the fins should physically contact the heat acceptor surface with minimal thermal contact resistance. Towards this end, contact points can be welded or brazed onto the fins; or alternatively, the fins can be pressure contacted to the heat acceptor surface. One embodiment comprises fashioning contact welds onto the fins. In this method, a copper bar is knurled with an axial rib pattern. The bar is sliced into discs from about 0.05 cm to about 0.5 cm in thickness; and one disc is then joined to a welding electrode rod (i.e., the axis of the rod is joined to the edge of the disc). Thereafter, as an intermittent current is applied through an electrode, the disc is rolled across the area of each fin, more specifically, each valley that will contact the heat acceptor surface. There is no necessity to put weld contacts onto the ridges of the fins that contact the combustion catalyst; and in fact, it is preferred not to do so. This welding method results in a series of uniform welds in close succession spanning the width of the disc.

Advantageously, the heat spreader provides for a uniform flow and heat distribution of the fuel/oxidant mixture and combustion gases along the heat acceptor surface contacting the heater head. The heat acceptor surface comprises any conventional heat conductive material capable of withstanding combustion conditions, suitable non-limiting examples of which include stainless steel and alloys, for example, nickel and steel alloys. The heat acceptor surface is secured in thermal contact with the heater head of the Stirling engine. Any form of thermal contact is envisioned making the apparatus of this invention adaptable to conventional and non-conventional heater head designs. For example, the heat acceptor surface can be secured in direct physical and thermal conductive communication (i.e., non-spaced apart relation) with the conductive material of the heater head. Alternatively, the heat acceptor surface can be positioned in convective thermal contact but spaced apart relation (i.e., not direct physical contact) with the conductive material of the heater head.

Heat flux from the heat acceptor surface to the heater head may occur radially or non-radially depending upon the design features of the heater head. In one preferred orientation, the heat acceptor surface is wrapped around a cylindrical heater head, thus providing for predominantly conductive radial heat flux into the heater head. In another preferred orientation, the heat acceptor surface is secured in contact with and parallel to a circular face at one end of a cylindrical heater head and thus perpendicular to the longitudinal axis of the heater head. In this preferred design heat flux occurs conductively and non-radially, specifically, down a longitudinal axis of the heater head. Other designs may be envisioned wherein the heat acceptor surface is positioned remotely at any angle relative to the longitudinal axis of the heater head, such that heat flux occurs predominantly convectively from the heat acceptor surface to the heater head.

The heat acceptor surface itself can have any shape that provides for the desired heat transfer including, for example, a flat, curved, cylindrical, or tubular shape, with or without fins, dimples, grooves, tubes, and/or other structures that facilitate heat distribution to the heater head. A flat or bowl shaped heat acceptor surface is preferred. The heater head, itself, may be oriented vertical to level ground or horizontally, that is, parallel to level ground.

Under operating conditions, Stirling engines including their heater head vibrate. As a consequence, the catalytic reactor apparatus of this invention advantageously is secured in a manner that dampens the vibrational stresses on certain reactor components. Specifically, the reactor housing comprising the combustion chamber is advantageously fastened to the heater head through a bellows or C-seal connection or other vibration-damping securing means. The fuel and oxidant inlet means are typically fastened to the housing/combustion chamber. The fuel nozzle/atomizer, and ignition means, and swirler, if any, are also fastened within the combustion chamber so as to avoid vibrational stresses. On the other hand, the heat acceptor surface (to which is secured in direct physical contact the heat spreader, which has secured thereto in direct physical contact the combustion catalyst) may or may not be secured directly to the heater head. When secured directly to the heater head, the heat acceptor surface and its sequentially connected heat spreader and combustion catalyst are expected to vibrate with the Stirling engine.

The fuel is injected, vaporized, mixed with air and ultimately oxidized catalytically. Vaporization, mixing and recuperation are the primary contributors to the overall catalytic reactor dimensions. For the reactor to be highly efficient, a recuperator is used to extract energy from the exhaust gases to preheat the inlet air.

Fuel nozzle/atomizer (FIG. 1(8) and FIG. 2(8)) functions to inject the fuel into the mixing chamber. The fuel nozzle is located such as to use bypassed inlet combustion air for nozzle cooling (an important feature to prevent deposits within the nozzle and fuel boiling). Up to about 20 percent of the air into the burner is routed to the combustion area along the fuel nozzle, bypassing the recuperator, so as to keep the temperature low. This prevents the fuel from heating to the point of creating coke/fuel deposits and spontaneous boiling away from the tip, causing erratic operation.

In another embodiment of the present invention, the catalytic burner employs an electrohydrodynamic liquid fuel dispersion system, generally referred to as an electrosprayer, as described in detail in U.S. Patent Application Publication No. 2004/0209205, referring to U.S. patent application Ser. No. 10/401,226, in the names of Gomez and Roychoudhury; filed on Mar. 27, 2003, and claiming priority to U.S. Provisional Patent Application No. 60/368,120.

To minimize the volume of the mixing chamber preceding catalytic conversion of fuel into combustion products, optionally, a swirling means (FIG. 1 (7) and FIG. 2 (7)) may be installed to provide a whirling flow field that introduces air with a tangential velocity component into the combustion chamber. This swirling embodiment shows markedly improved temperature uniformity on the catalytic surface, which is crucial for efficient coupling with a Stirling engine. Uniformity of temperature relates directly to the homogeneity of the local equivalence ratio, defined as the ratio of the local mole ratio of actual fuel/oxidant combusted relative to the mole ratio of fuel to oxidant of the stoichiometric combustion reaction (i.e., the fuel/oxidant mole ratio that satisfies complete conversion of fuel to $CO_2$ and $H_2O$). In a preferred embodiment, a low pressure drop radial swirler is coaxially located with the fuel nozzle a few millimeters downstream of the nozzle/atomizer. This preferred embodiment results in uniform mixing of the inlet air, including fresh and recuperated air, and the fuel droplets. In a preferred embodiment, the swirler can be made of a Nickel-Chrome strip corrugated at about a 30 degree angle and formed into a circular part inducing about a 30 degree swirl to the incoming air.

The fuel is essentially fully vaporized and mixed with the oxidizer in the mixing chamber and directed towards the catalyst. Catalyst light-off can be implemented through a conventional ignition means, such as a glow plug, spark, or a cable heater adjacent to the catalyst substrate. In the glow plug or spark method, a flame obtained from ignition of the fuel and air heats the catalyst to its light-off temperature, at which temperature the catalytic combustion is self-sustaining. At this temperature the flame is typically extinguished either by increasing air flow or decreasing fuel flow while maintaining flameless catalytic combustion.

Any conventional oxidant may be employed in the catalytic reactor, preferably, a gaseous oxidant, more preferably, air, oxygen, or any mixture of oxygen and nitrogen. The invention is not limited to these conventional oxidants; and other oxidants, such as ozone, or a mixture of oxygen with an inert gas, e.g., helium, may be employed if desired. Likewise, any conventional fuel may be employed in the catalytic reactor, including gaseous and liquid hydrocarbons, for example, methane, ethane, propane, butane, aromatics, naphthenes, long chain paraffins (e.g., $C_{6-16}$ paraffins), cycloparaffins, and mixtures thereof. A preferred fuel comprises a mixture of liquid hydrocarbons, more preferably, those liquid hydrocarbon mixtures used as diesel and/or jet fuels, including but not limited to JP-4, JP-5, JP-7, and JP-8. Most preferably, the fuel employed is JP-8 fuel.

The average residence time of the fuel/oxidant mixture across the catalyst is estimated at about 0.8 milliseconds (ms), which, as expected, is much smaller than the estimated evaporative and mixing time of the fuel with oxidant. The prevailing Peclet number, which controls the necessary packing density to achieve essentially complete fuel conversion, is estimated at 30, which may require the stacking of several layers of catalyst for fuel conversions greater than about 90 percent. Thus, the catalytic metal substrate may be used in one layer, if desired; but, stacking a plurality of layers from about 2 to about 20 layers, is preferred. Since durability tests show that the catalyst performance does not deteriorate significantly over a period of about 500 hours or more, it is anticipated that replacement of the catalyst may not be needed more frequently than about 1000 hours or more of operation.

Advantageously, the combustion reactor is operated at an equivalence ratio ranging from about 0.2:1 to about 1:1, wherein the equivalence ratio is defined as the ratio of the mole ratio of actual fuel to oxidant combusted relative to the mole ratio of fuel to oxidant of the stoichiometric combustion reaction (i.e., the fuel/oxidant mole ratio that satisfies complete conversion of fuel to $CO_2$ and $H_2O$). Flow rates of the fuel and oxidant, as well as operable temperature and pressure ranges for the catalytic combustion, are known in the art. Temperature on the catalyst surface and downstream of the catalyst advantageously ranges from about 600° C. to about 800° C., preferably from about 650° C. to about 750° C.

Combustion exhaust gases flow through the channels in the heat spreader, and then the exhaust gas is conventionally vented to the atmosphere through one or more outlet means. Preferably, the exhaust gases are contacted with a recuperator, wherein heat from the exhaust is recovered prior to venting into the atmosphere. Recuperation advantageously reduces the temperature of the combustion gases, which therefore allows for a reduced quantity of heat being exhausted into the atmosphere. For overall heat efficiency of the burner, heat recovered through the recuperator is advantageously used to pre-heat inlet air. In addition to boosting overall thermal efficiency, the recuperator has the important function of reducing liquid fuel droplet/stream evaporation time by elevating the average temperature at the air inlet advantageously to greater than about 400° C. (but less than the temperature at the catalyst), which increases the evaporation coefficient several fold.

Figure 5:
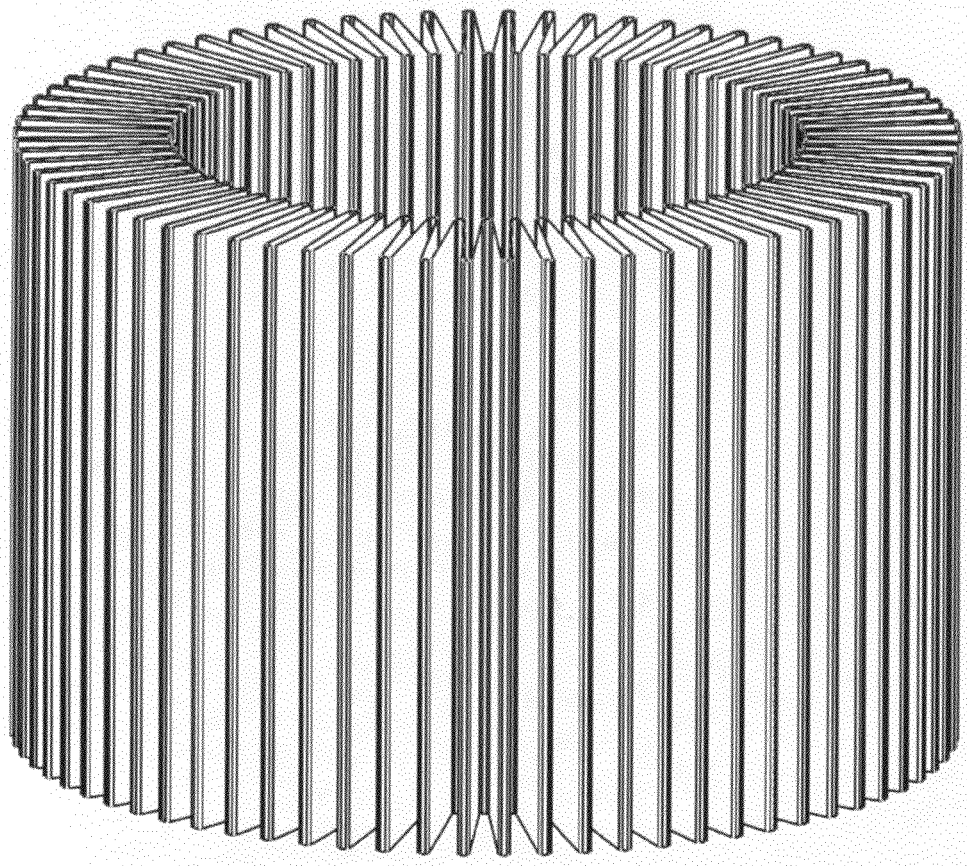
FIG. 5 depicts a fin structure of a recuperator in accordance with the present invention.

The exhaust gas is routed advantageously through a recuperator comprising a counterflow heat exchanger consisting of a corrugated metal lamina, preferably corrugated stainless steel, separating the exhaust from the incoming air, while allowing for heat transfer between the two gases. The recuperator may occupy a cylindrical, preferably, corrugated cylindrical, jacket (FIG. 5) wrapping the burner. This geometric configuration is also chosen to avoid preheating the fuel line because of the fouling risk associated with the use of JP-8 fuel. Temperature measurements via K-type thermocouples at the inlet and outlet of the recuperator yield an estimated heat recovery effectiveness of greater than about 70 percent, preferably, up to about 85 percent, of the exhaust gas heat. The exhaust gas temperature may be further decreased by contacting the exhaust gas with a heat exchanger employing a liquid heat exchange fluid or by mixing the exhaust gas with engine cooling air, so as to lower the system thermal signature.

As shown in FIG. 1 and FIG. 2, recuperator 9 can be integrated with the burner such as to shield the hot zone (via an extension of the recuperator) and also to provide the external burner housing. Insulation can be applied to this housing.

The Balance of Plant (BOP) consists of an air blower, fuel pump, igniter, instrumentation, and controls, preferably designed as lightweight, compact, low power draw components. In order to minimize the air blower parasitic draw, a low pressure drop recuperator and flow path are designed and integrated with a controllable, low flow, JP-8 tolerant, inexpensive liquid fuel pump. A resistively heated element, analogous to a glow plug, can be used to light off the catalyst in the presence of fuel and air, at ambient conditions (taken as about 22° C. and 1 atmosphere pressure). The total burner parasitic load consisting of the air blower, fuel pump, and control system is advantageously less than about 150 Watt energy (We). A control logic for startup, shutdown and load change is advantageously identified and implemented via PID controllers in a manner known to one skilled in the art.

EMBODIMENT OF THE INVENTION

A catalytic combustor was constructed according to the invention. The housing was constructed of stainless steel. A flat heat acceptor surface was provided in the form of a circular flat piece of stainless steel 304 (8 inch diameter× 0.060 inch thick, i.e., 20 cm diameter×0.15 cm thick). Contacting the heat acceptor surface was a heat spreader constructed from 0.003 inch (0.075 mm) thick Grade 304 stainless steel sheet. The sheet was bent into a plurality of corrugated fins (1 inch long by ½ inch high, 10 fins/inch) (2.50 cm long by 1.25 cm high, 4 fins per cm), as shown in FIG. 4. A series of resistance welds was made onto the valley of each fin (bottom furrows contacting heat acceptor surface) by means of the copper electrode method described in detail hereinabove. A Microlith® brand combustion catalyst obtained from Precision Combustion, Inc. of North Haven, Conn., and comprising noble metal deposited on ultra-short-channel-length metal mesh substrate, was positioned in direct physical contact with the heat spreader. With reference to FIG. 3, the heat spreader 2 so constructed provided heat conduction from the combustion catalyst 1 to heat acceptor surface 3, as well as providing a plurality of channels for distributing hot combustion gases.

JP-8 fuel and air were the chosen fuel and oxidant, respectively. A fuel/air flow path (FIG. 1, parts 4, 5, 6) constructed of stainless steel was located above the catalyst. A fuel nozzle/injector 8 was located at the outlet of the fuel/air flow path. A commercially available fuel atomizer was used to provide a fine fuel spray into the combustor. A stainless steel swirler 7 was located co-axially to the fuel nozzle to provide mixing between the fuel and air streams. The air stream was split into two inlet streams: an air stream fed at 740 SLPM through air first inlet means 5 and a secondary air stream fed at 5 SLPM through air second inlet means 6. Air stream passing through inlet 6 was fed at ambient temperature (23° C.); whereas to simulate the use of a recuperator, air stream passing through inlet 5 was fed through a pre-heater to raise the temperature to 350° C. Air passing through air inlet 6 was injected with JP-8 fuel fed through fuel inlet 4 into the combustion chamber 10. Fuel flow was 11 g/min.

The burner, constructed as shown in FIG. 1 with the exception that the catalyst-heat spreader-heat acceptor surface was constructed as shown in FIG. 3, was rotated 180° such that the heat acceptor surface (3) was positioned on top and the catalytic burner (1) positioned on bottom. A beaker of water was placed on the heat acceptor surface to simulate heat transfer to a heater head of a Stirling engine. Under operating conditions, the temperatures of the inlet fuel/air mixture, the catalyst, the heat acceptor surface, and the exhaust gases were monitored as a function of time. Temperature data with and without the water beaker are presented in Table 1.

TABLE 1

Temperature vs. Time

| Location | No $H_2O$ Temp ° C. | With $H_2O$ Temp ° C. |
|---|---|---|
| Preheated Air Inlet | 200 | 199 |
| Cat. Center | 675 | 603 |
| Cat 3" Off-Center | 802 | 790 |
| Surface Center | 498 | 93 |
| Surface 3" Left | 637 | 102 |
| Surface 3" Back | 680 | 101 |
| Exhaust Gas (Simulated Recuperated) | 774 | 727 |

Figure 6:
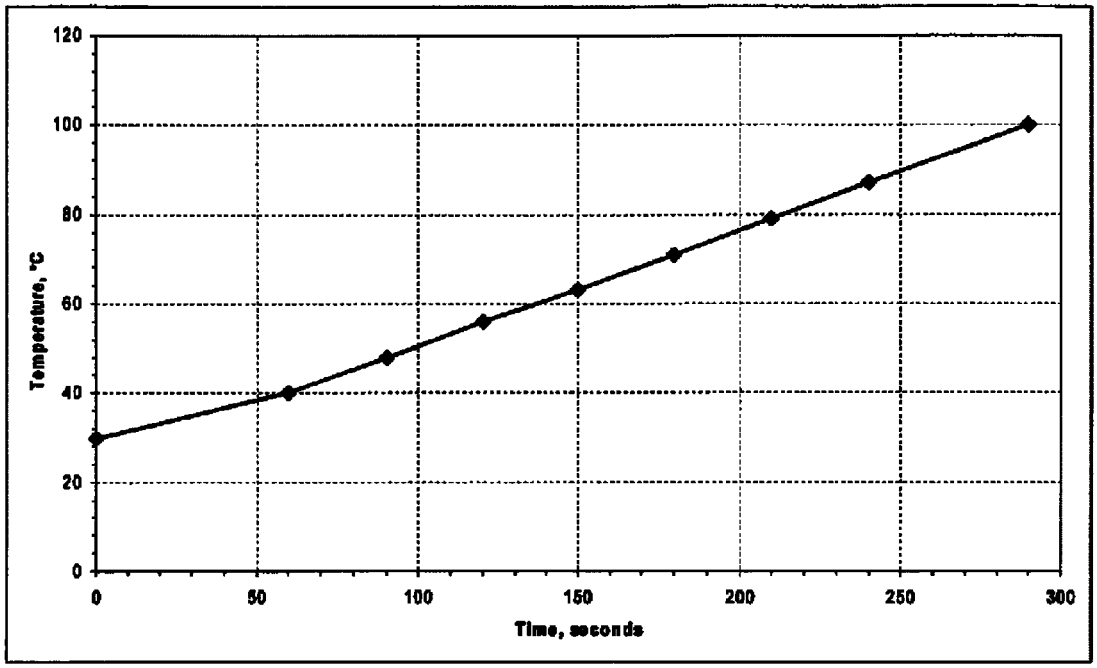
FIG. 6 provides a graph of temperature versus time in the operation of an apparatus of the present invention.

From Table 1, it is seen that temperatures at the fuel/air inlet and catalyst sites were closely similar for operation with and without the water-filled beaker. In contrast, the temperature of the heat acceptor surface was significantly reduced when a water-filled beaker was placed on the surface, as compared to when no water beaker was used. This result implies that heat from the heat acceptor surface was transmitted rapidly and substantially to the water-filled beaker simulating heat transfer to the heater head of an external combustion engine. The exhaust gases exited at a somewhat cooler temperature when the water-filled beaker was used. FIG. 6 depicts a plot of water temperature as a function of operating time. It is seen that the water reached a boiling temperature of 100° C. in only 300 seconds (5 min).

While the present invention has been described in considerable detail, other configurations exhibiting the characteristics taught herein are possible for improved heat generation and transfer of heat to the heater head of a Stirling Engine. Therefore, the spirit and the scope of the invention are not to be considered limited to the description of the preferred embodiments described herein.

The invention claimed is:

1. A catalytic reactor apparatus for generating heat and transferring the heat to a heater head of a Stirling engine, the apparatus comprising the following components:

(a) a housing comprising a combustion chamber;

(b) a fuel inlet means for feeding a fuel into the chamber;

(c) an oxidant first inlet means for feeding an oxidant into the chamber;

(d) a combustion catalyst positioned within the chamber in fluid communication with the fuel and oxidant inlet means;

(e) a heat acceptor surface positioned within the chamber downstream from the catalyst, the heat acceptor surface positioned in thermal communication with a heater head of a Stirling engine;

(f) a heat spreader positioned in between the catalyst and the heat acceptor surface and contacting both the catalyst and the heat acceptor surface;

(g) an ignition means positioned within the chamber for igniting the catalyst and thus initiating flameless combustion of the fuel with the oxidant; and (h) one or more outlet means for exhausting combustion gases from the chamber.

2. The catalytic reactor of claim 1 wherein the heat spreader and the heat acceptor surface are provided as one composite component.

3. The catalytic reactor of claim 1 wherein the heat spreader and the heat acceptor surface are provided as two separate components.

4. The catalytic reactor of claim 1 wherein the heat acceptor surface has a flat or bowl shape.

5. The catalytic reactor of claim 1 wherein the heat acceptor surface is secured to a circular face at one end of a cylindrical heater head providing for heat flux along a longitudinal axis of the heater head.

6. The catalytic reactor of claim 1 further comprising a nozzle/atomizer for vaporizing the fuel prior to combustion.

7. The catalytic reactor of claim 1 further comprising a swirling means for mixing the fuel and oxidant prior to contact with the catalyst.

8. The catalytic reactor of claim 1 further comprising a recuperator comprising a heat conductive wall separating the oxidant first inlet means from the outlet means for exhausting combustion gases.

9. The catalytic reactor of claim 1 wherein the catalyst comprises an ultra-short-channel-length metal substrate.

10. The catalytic reactor of claim 9 wherein the catalyst comprises an ultra-short-channel-length metal mesh substrate having deposited thereon one or more noble metals.

11. An improved Stirling engine having a piston undergoing reciprocating linear motion within an expansion cylinder containing a working fluid heated through a heater head; the improvement employing a catalytic reactor for generating heat and transferring the heat to the heater head, the reactor comprising:

a) a housing comprising a combustion chamber;

(b) a fuel inlet means for feeding a fuel into the chamber;

(c) an oxidant first inlet means for feeding an oxidant into the chamber;

(d) a combustion catalyst positioned within the chamber in fluid communication with the fuel and oxidant inlet means;

(e) a heat acceptor surface positioned within the chamber downstream from the catalyst, the heat acceptor surface being secured in thermal communication with a heater head of a Stirling engine;

(f) a heat spreader positioned in between the catalyst and the heat acceptor surface and contacting both the catalyst and the heat acceptor surface;

(g) an ignition means positioned within the chamber for igniting the catalyst and thus initiating flameless combustion of the fuel with the oxidant; and (h) one or more outlet means for exhausting combustion gases from the chamber.

12. The external combustion engine of claim 11 wherein the heat acceptor surface is secured to a circular face at one end of a cylindrical heater head providing for heat flux along a longitudinal axis of the heater head.

13. The external combustion engine of claim 11 wherein the heat acceptor surface has a flat or bowl shape.

14. The external combustion engine of claim 11 wherein the combustion catalyst comprises an ultra-short-channel-length metal substrate.

15. The external combustion engine of claim 14 wherein the combustion catalyst comprises an ultra-short-channel-length metal mesh substrate having deposited thereon one or more noble metals.

16. A method of generating heat and transferring the heat to a heater head of a Stirling engine, the method comprising:

(1) employing a catalytic reactor for generating heat and transferring the heat to the heater head, the reactor comprising (a) a housing comprising a combustion chamber; (b) a fuel inlet means for feeding a fuel into the chamber; (c) an oxidant first inlet means for feeding an oxidant into the chamber; (d) a combustion catalyst positioned within the chamber in fluid communication with the fuel and oxidant inlet means; (e) a heat acceptor surface positioned within the chamber downstream from the catalyst, the heat acceptor surface being secured in thermal communication with a heater head of a Stirling engine; (f) a heat spreader positioned in between the catalyst and the heat acceptor surface and contacting both the catalyst and the heat acceptor surface; (g) an ignition means positioned within the chamber for igniting the catalyst and thus initiating flameless combustion of the fuel with the oxidant; and (h) one or more outlet means for exhausting combustion gases from the chamber;

(2) feeding a fuel through the fuel inlet means into the combustion chamber;

(3) feeding an oxidant through the oxidant first inlet means into the combustion chamber;

(4) in the chamber, contacting the fuel and the oxidant with the combustion catalyst;

(5) igniting the catalyst so as to initiate flameless combustion of the fuel with the oxidant thereby generating heat of combustion, the heat being transferred from the combustion catalyst to the heat acceptor surface and therefrom to the heater head into the Stirling engine; and (6) exhausting combustion gases through the one or more outlet means.

17. The method of claim 16 wherein the heat acceptor surface is secured to a circular face of one end of a cylindrical heater head providing for heat flux along a longitudinal axis of the heater head.

18. The method of claim 16 wherein the heat acceptor surface has a flat or bowl shape.

19. The method of claim 16 wherein the fuel is atomized into droplets/streams and vaporized prior to contact with the combustion catalyst.

20. The method of claim 16 wherein the fuel and oxidant are mixed with a swirler prior to contact with the combustion catalyst.

21. The method of claim 16 wherein the combustion exhaust gases are passed through a recuperator to extract heat, which heat is employed to raise the temperature of the oxidant fed through the oxidant first inlet means.

22. The method of claim 16 wherein the combustion catalyst comprises an ultra-short-channel-length metal substrate.

23. The method of claim 22 wherein the ultra-short-channel-length metal substrate comprises an ultra-short-channel-length metal mesh substrate having deposited thereon one or more noble metals.

24. The method of claim 16 wherein the fuel is JP-8 fuel and the oxidant is air or oxygen.

* * * * *